United States Patent [19]

Mateju et al.

[11] 3,933,183

[45] Jan. 20, 1976

[54] METHOD OF AND WEFT INSERTER FOR ELIMINATING A CHAIN FORMATION OF WEFTS NOT TRANSFERRED INTO THE BEAT-UP POSITION IN TRAVELLING-WAVE SHEDDING LOOMS

[75] Inventors: Vladimir Mateju; Zdenek Zabrodsky; Vitezslav Vasek; Frantisek Jekl, all of Usti nad Orlici, Czechoslovakia

[73] Assignee: Vyzkumny ustav bavlnarsky, Usti nad Orlici, Czechoslovakia

[22] Filed: Oct. 21, 1974

[21] Appl. No.: 516,733

[30] Foreign Application Priority Data

Oct. 24, 1973 Czechoslovakia ..... 7322-73

[52] U.S. Cl. ..... 139/12; 139/196.3

[51] Int. Cl.[2] ..... D03D 47/24; D03J 5/06

[58] Field of Search ..... 139/11, 12, 13 R, 13 A, 139/15, 190, 197, 196.3

[56] References Cited

UNITED STATES PATENTS 3,766,950 10/1973 Vasek et al. ..... 139/12

3,848,641 11/1974 Zabrodsky et al. ..... 139/12

*Primary Examiner*—Henry S. Jaudon

[57] ABSTRACT

Method of and apparatus for eliminating a chain formation of wefts not transferred into the beat-up position of a travelling-wave shedding loom with weft inserters and a rotary reed comprising discs with cutouts for engaging weft and displacing it to the fabric fell. An interwoven but not transferred weft is introduced into the cutouts of the discs of the rotary reed; such cutouts corresponding to the next weft inserter, in lieu of the weft from said next weft inserter. The weft from the next weft inserter is introduced into the cutouts of the discs of the rotary reed, such cutouts corresponding to the next following weft inserter. Due to this phase-shift corresponding to the distance between two weft inserters following after each other, all the other wefts are successively directed into the cutouts of the discs of the rotary reed until the loom stops.

8 Claims, 9 Drawing Figures

METHOD OF AND WEFT INSERTER FOR ELIMINATING A CHAIN FORMATION OF WEFTS NOT TRANSFERRED INTO THE BEAT-UP POSITION IN TRAVELLING-WAVE SHEDDING LOOMS

The present invention relates to a method of and a weft inserter for eliminating a chain formation of wefts not transferred into the beat-up position in a weaving loom having a travelling-wave shed produced by heddles controlled either individually or in sections. Such a loom is equipped with a fixed reed designed to guide warp threads and with a rotary reed consisting of discs engaged into warp thread spacings and having cutouts for engaging weft and displacing it to the fabric fell, said cutouts in said face-to-face arranged discs being offset with respect to each other so as to form in common a helical groove. Each weft inserter is conveyed through the shed in a shed wave which opens progressively in front of it and closes behind it, in synchronization with the rotary reed rotation.

During the weaving process it may sometimes happen that a foreign body, as for example, a short weft remainder left in the shed by the weft inserter, dust clump, or piece of broken warp thread, etc., penetrates into the shed angle. Upon a shed exchange, the aforesaid foreign body will be interwoven by the warp in the so-called transferring zone of the shed angle, i.e. in the space where the weft is introduced into the cutouts of the discs of the rotary reed. In this way, an obstacle arises to the transfer of the weft into the beat-up position, since the weft inserter passes the foreign body and lays the weft into a false position upstream of said body so that the weft fails to be engaged by the disc cutouts of the rotary reed. During the next shed exchange the aforementioned weft is interwoven within said transferring zone of the shed angle and produces an obstacle for the next weft, and so forth. This failure, that is, the weft not being transferred into the beat-up position, will be then repeated with all the weft inserters following one after another in this critical place of interlacing a foregin body, until an appropriate stop motion switches off the machine. Thus in the transferring zone of the shed angle, there is produced a defective fabric zone composed of woven-in but not transferred wefts. These wefts have to be unwoven and moreover some accompanying faults such as warp overruns into adjacent rotary reed spacings, warp thread breakages, etc., have to be corrected. It is evident that the unwoven wefts are missing in the fabric so that an irreparable weaving fault will arise.

It is an object of the invention to avoid the aforedescribed chain formation of untransferred wefts woven-in in the transferring zone of the shed angle.

In the method according to the invention, an interwoven but untransferred weft is introduced into the cutouts of the discs of the rotary reed, which cutouts correspond to the next weft inserter, while the weft from the next inserter is either severed or introduced into the rotary reed disc cutouts corresponding to the following inserter, whereupon due to this phase shift corresponding to the distance between two weft inserters following after each other, all the other wefts are successively directed into the rotary reed disc cutouts before the loom stops.

The weft inserter for carrying out the aforedescribed method, comprising a rotatable bobbin with a weft length determined for a single pick, and a spreading spring for spreading warp threads, is characterized according to the invention in that it comprises directing means for introducing an interwoven but untransferred weft from the preceding weft inserter into the cutouts of the discs of the rotary reed, said cutouts corresponding to the next weft inserter.

The directing means can be constituted by a spring tail provided in the weft inserter between the spreading spring and a weft guide.

According to a preferred embodiment, bobbin rotation blocking means are associated with the directing means, said means being controllable by the spreading spring. The bobbin rotation blocking means can be embodied as a ratchet wheel provided on the bobbin and as a spring-loaded pawl to cooperate with said ratchet wheel and received in the weft inserter so as to be displaced from an inoperative position of not engaging said ratchet wheel, into an operative position with the outstanding spreading spring, in which operative position said pawl is in engagement with said ratchet pawl. The pawl is resiliently forced against a plate received in a pocket-like recess in the inserter body and secured to the spreading spring.

The weft thread which has been laid upstream of the interwoven foreign body, and consequently beyond reach of the respective cutouts of the discs of the rotary reed, is displaced by the directing means or spring tail of the weft inserter with the assistance of warp threads, to the periphery of the rotary reed where it is engaged by the disc cutouts and transferred by them to the fabric fell. However, the weft thread from said next inserter is not introduced into the corresponding disc cutouts when it is severed or when it is introduced with the same shift as the preceding weft into disc cutouts corresponding to the next inserter. In the first mentioned case, the weft is severed in that the spreading spring, due to an obstacle, the untransferred woven-in weft having shortened the shed angle, for example, is deflected and forces the pawl into engagement with the toothed rim of the bobbin. In this manner the rotation of the bobbin becomes blocked so that, as the inserter proceeds in its movement through the shed, the weft tension between the bobbin and the fabric fell rises, until the weft breaks. The weft thread from the next inserter will have been already introduced into the corresponding disc cutouts of the rotary reed which will beat it up to the fabric fell.

In the second case, the weft thread laid upstream of the interwoven foreign body will be introduced by the directing means or spring tail of the next inserter only into the corresponding disc cutouts of the rotary reed. However, the weft from said next inserter will not break but is introduced into the disc cutouts corresponding to said next inserter, which is repeated even with other weft until the loom stops.

By using the method according to the invention, the time necessary for remedying the failure can be substantially shortened, since the wefts in the defective fabric need not be unwoven, and overruns and warp thread breakage need not be corrected; as a consequence the quality of the final product is improved.

In order that the invention may be better understood and carried into practice, some preferred embodiments thereof will be hereinafter described with reference to the accompanying schematic drawings which, however, are not intended to limit the invention scope in any way.

Figure 1:
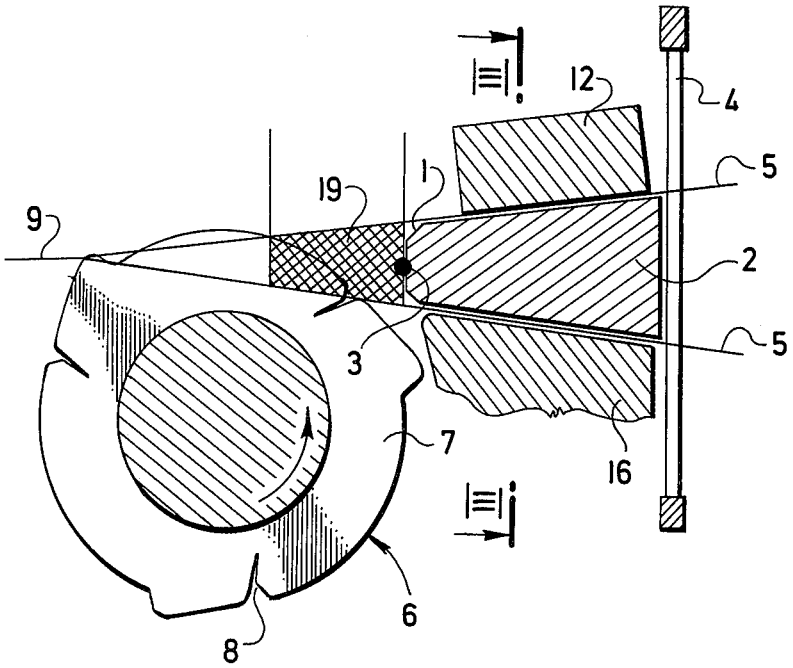
FIG. 1 is a detail view of a travelling-wave shedding loom, partially in longitudinal section.

It is known that in travelling-wave shedding looms (FIGS. 1 and 2) there are formed successive weaving sheds 1 by means of heddles (not shown) which latter are controlled, either individually or in groups, so that in the zone passed through by an inserter 2 of weft yarn 3 the shed angle is always open whereupon after the inserter passage, the shed 1 becomes closed and exchanged to be ready for receiving the next weft yarn inserter 2. The travelling-wave shedding loom is equipped, as a rule, with a fixed reed 4 (FIG. 1, 2, 3, 7, 8 and 9) for guiding warp yarns 5, and a rotary reed 6 consisting of discs 7 operating between adjacent warp yarns 5, respectively. The discs 7 of the rotary reed 6 are provided with cutouts 8 for engaging the weft yarn 3 and displacing it to the fell of the fabric 9.

Figure 7:
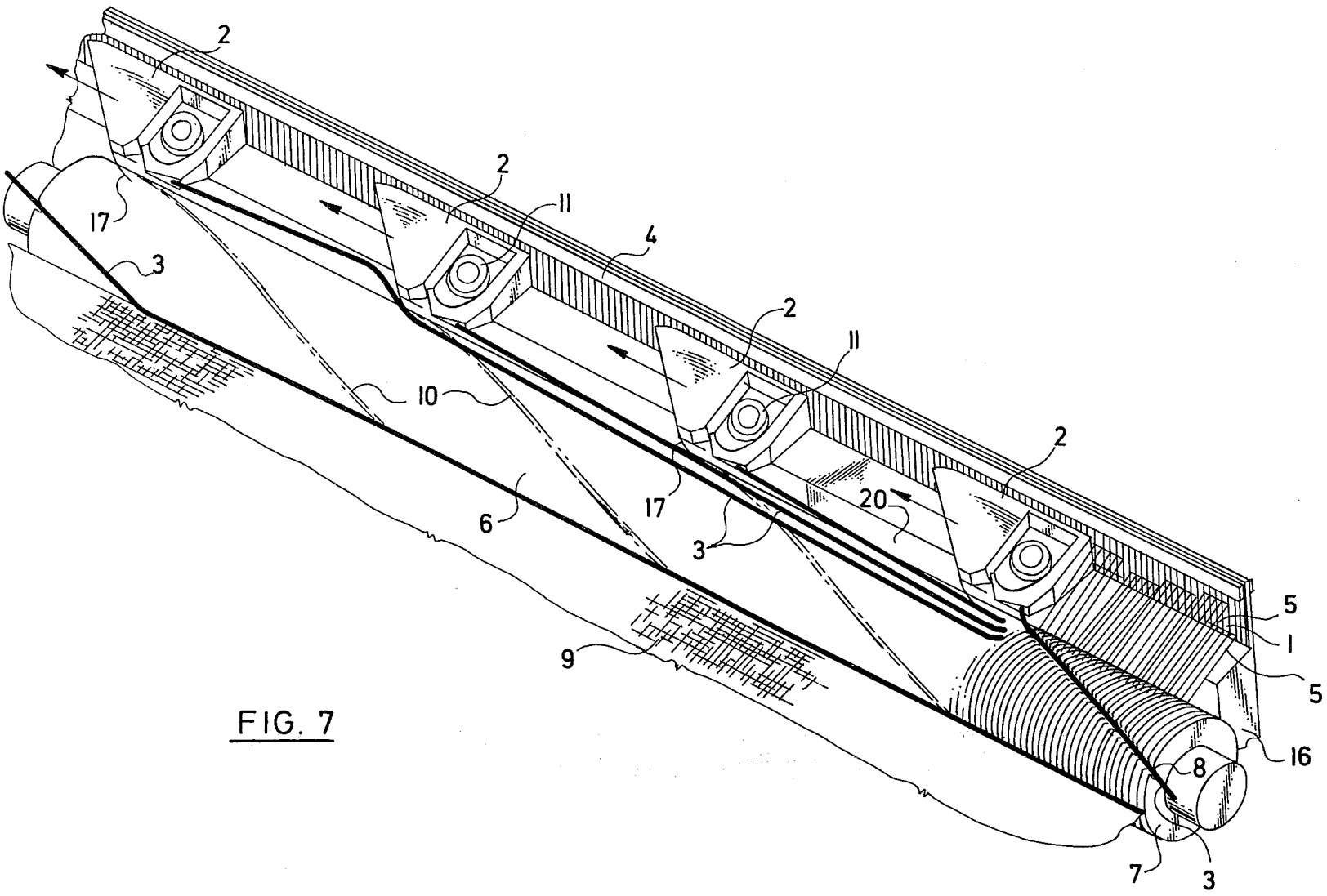
FIG. 7 is a perspective detail view of a travelling-wave shedding loom during the chain formation of untransferred wefts, warp threads having been omitted.
Figure 8:
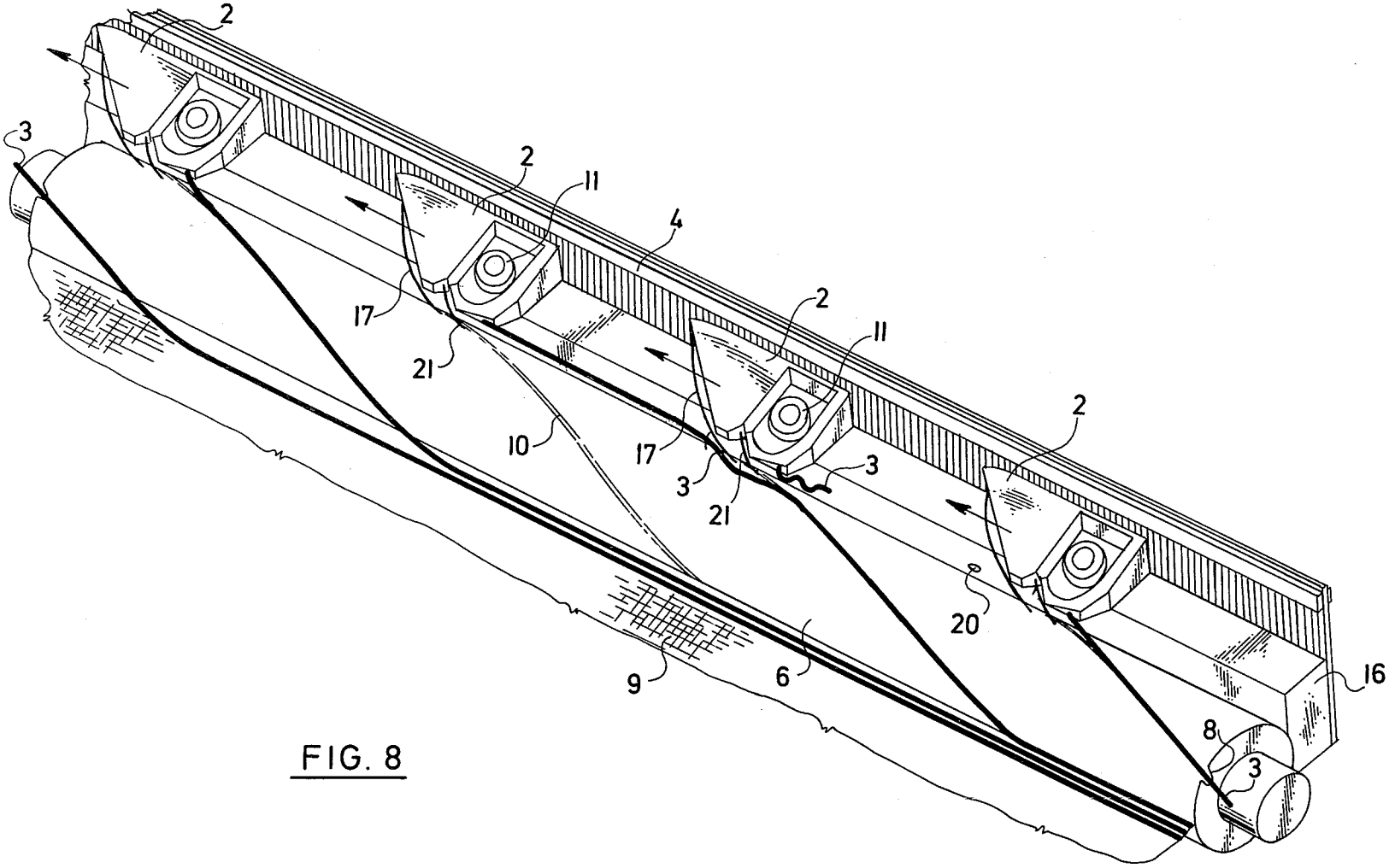
FIG. 8 is a detail view similar to FIG. 7, showing weft inserters illustrated in FIGS. 3, 4 and 5, for practicing the method of the invention of eliminating the chain formation of the untransferred wefts.
Figure 9:
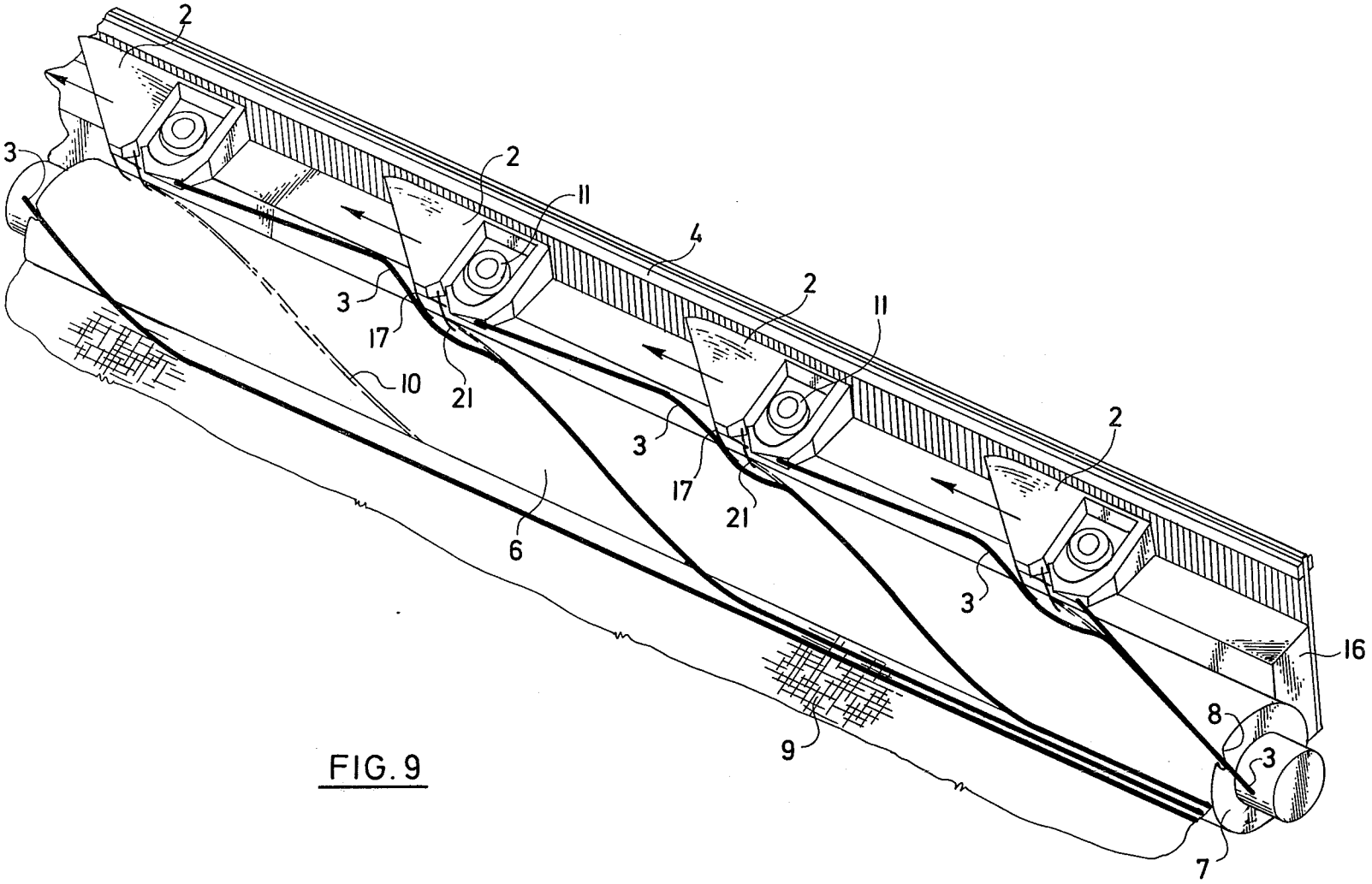
FIG. 9 is a detail view similar to FIGS. 7 and 8 showing weft inserters illustrated in FIG. 6, for practicing the method of eliminating the chain formation of untransferred wefts.

As is apparent from FIGS. 7, 8 and 9, the cutouts 8 of the adjacent discs 7 within the whole rotary reed 6 are offset relative to each other so as together to form a helical groove 10. Thus in operation, the weft inserters 2 are conveyed through the weaving zone of the loom so as to advance in the shed wave opening before them and closing after them, in synchronism with the rotation of the rotary reed 6.

The weft inserter 2 is in the shape of an elongated, frontally pointed body. In a recess provided therein, a bobbin 11 is mounted for rotation (FIGS. 3, 7 8 and 9) which bobbin 11 is designed to receive from a spooling device (not shown) a reserve length of weft yarn 3 sufficient for a single pick. It is to be understood that during the movement of the weft inserter 2 through the weaving shed 1, the weft yarn 3 is being unwound from the bobbin 11.

Further, the weft inserter 2 is provided with guide surfaces to mate with corresponding surfaces of the fixed reed 4 (FIGS. 1, 2, 3, 7, 8 and 9) and an upper guideway 12, the latter being disposed just above the upper shed sheet. The weft inserter 2 is adapted to be guided on said reed 4 and on said guideway 12. The means for driving the weft inserter 2 in the weaving shed 1 comprises a roll 13 arranged on its lower side (FIG. 3) and designed to cooperate with a drive roller 14 secured to a drive chain 15, the latter being arranged in a lower guideway 16 below the lower shed sheet.

During its passage through the shed 1, the weft inserter 2 periodically has to clear the shed angle, to make its way through the shed 1. This operation is necessary, for instance, in the case of so-called cottered ends. For this purpose, the weft inserter 2 is equipped with a spreading spring 17 (FIGS. 5 through 9).

Further, the weft inserter 2 is provided with a weft guide 18 (FIGS. 4, 5 and 6) for guiding the weft yarn 3 being unwound from the bobbin 11 and inserted into the weaving shed 1. The weft guide 18 can be made, for example, as a peg.

FIG. 1 shows the weft inserter 2 as being conveyed through a shed angle formed from an upper sheet above which the upper guideway 12 for the weft inserters 2 is provided, a lower sheet below which the lower guideway 16 for the weft inserters 2 is provided, and from the fixed reed 4. The weft transferring zone 19 of the shed angle, i.e. the space in which the weft yarn 3 is introduced into the cutouts 8 of the discs 7 of the rotary reed 6 by which the weft yarn 3 is transferred to the fabric 9 and beaten up into the fell thereof, is cross-hatched in FIG. 1.

Figure 2:
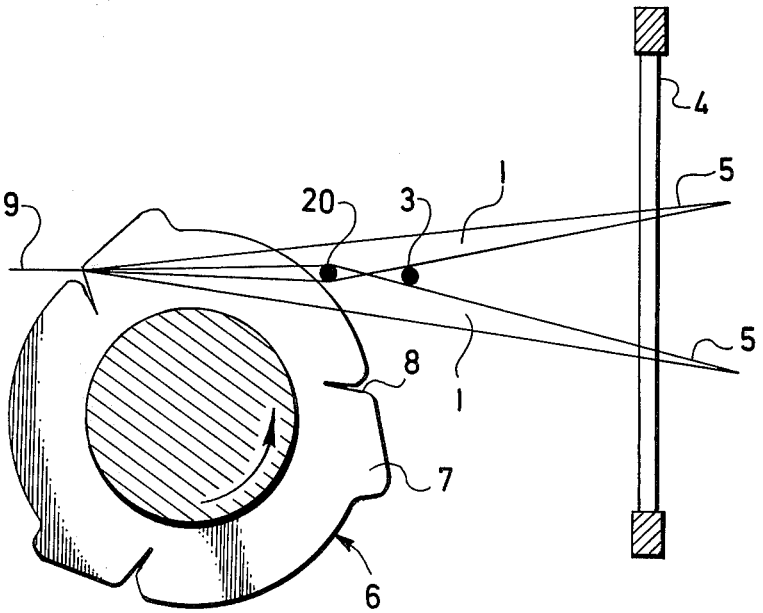
FIG. 2 is a view similar to FIG. 1, illustrating a foreign body interwoven downstream of a not woven-in weft, the weft inserter having been omitted.

In FIG. 2 there is shown a foreign body 20 which is woven in within the weft transferring zone 19 of the shed angle whereby the shed 1 becomes shortened in the next shed wave. The weft inserter 2 passing through said shortened shed 1 will lay the weft yarn 3 into a position upstream of said foreign body 20 so that the weft yarn 3 cannot be introduced into the cutouts 8 of the respective discs 7 of the rotary reed 6 and is immediately interlaced by warp yarns 5 as early as in the weft transferring zone 19 of the shed angle.

Such a faulty operation arising in prior art devices after a foreign body 20 has intruded into the shed angle is shown in FIG. 7. An untransferred weft yarn 3 is interwoven by the warp 5 in the transferring zone 19 of the warp shed angle and prevents the next weft yarn 3 from being introduced into the respective cutouts 8 of the discs 7 of the rotary reed 6. Such a weft yarn 3 constitutes an obstacle for the next weft 3, which results in chain-like formations of wefts 3 woven-in but untransferred into the beat-up position.

Figure 3:
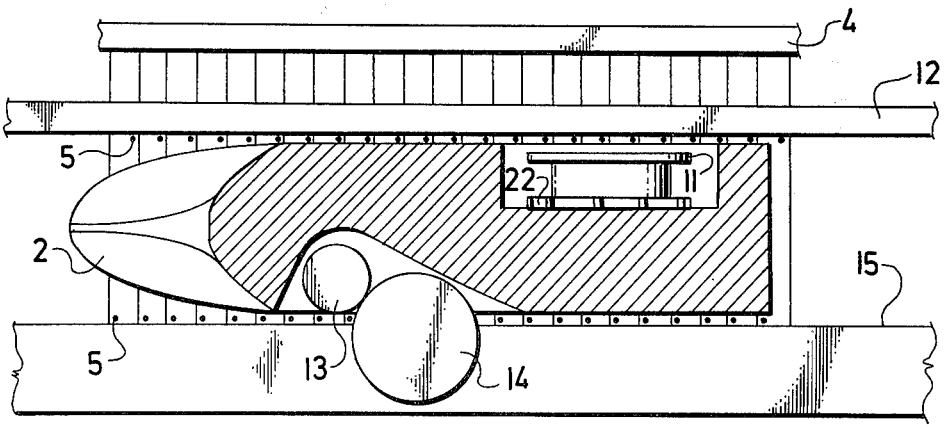
FIG. 3 shows a first embodiment of a weft inserter in a sectional view taken along the line III—III in FIG. 1, and illustrates means for driving the inserter in the weaving shed.
Figure 4:
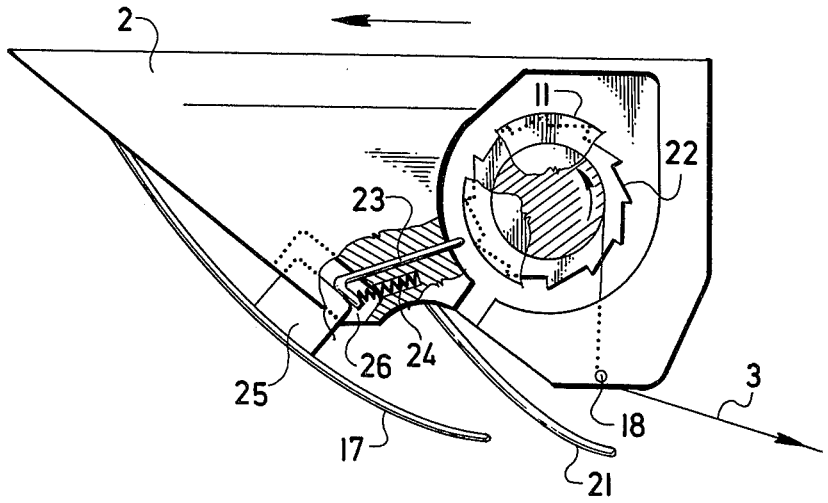
FIG. 4 is a top view of the same embodiment of weft inserter as that shown in FIG. 3, the pawl being in its inoperative position.
Figure 5:
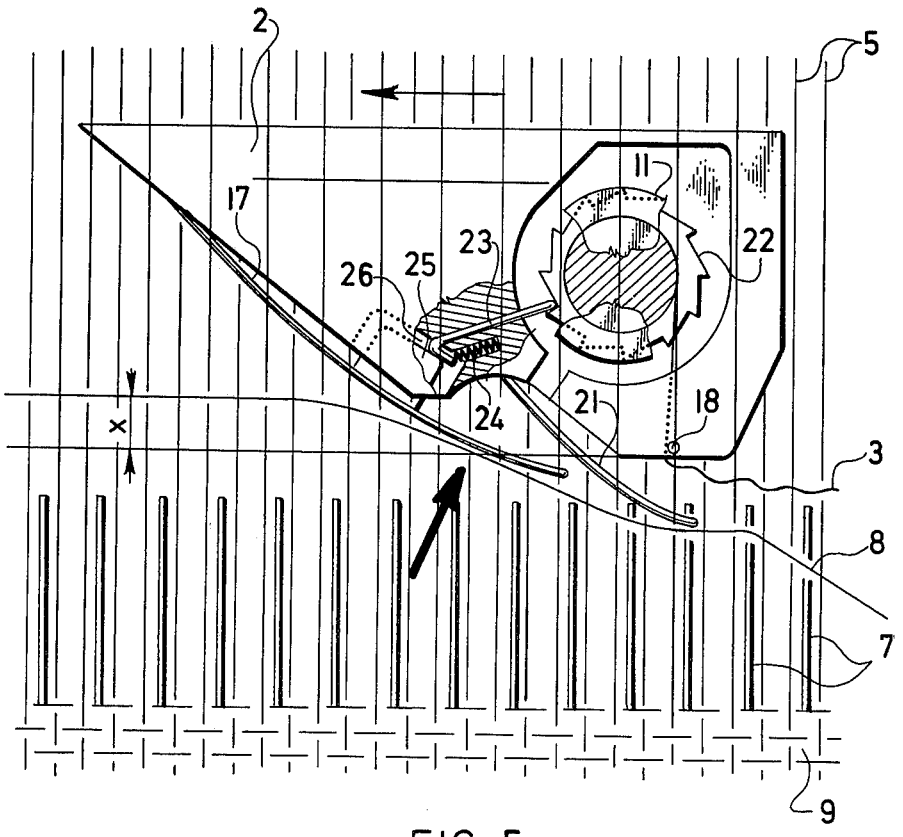
FIG. 5 is a top view of the same weft inserter in the weaving shed, additionally illustrating the discs of the rotary reed and the pawl in its operative position.

FIGS. 3, 4 and 5 show one of the embodiments of the present invention by which the aforementioned chain-like formation of the wefts 3 untransferred into the beat-up position is eliminated as is apparent from FIG. 8. The weft inserter 2, as shown in FIGS. 3, 4 and 5, is provided with a spring tail 21 disposed between the weft guide 18 and the spreading spring 17. The bobbin 11 of the weft inserter 2 is provided with a ratchet wheel 22 associated with pawl 23 the latter being forced by a spring 24 toward a plate 25 attached to the spreading spring 17. The plate 25 is received in a pocket recess 26 provided in the body of the weft inserter 2.

As shown in FIG. 5, the weft 3 which, due to the presence of a foreign body 20 woven-in into the shed angle, has not been engaged by the cutouts 8 of the rotary reed 6 in the preceding shed wave (see also FIG. 8) and consequently untransferred to the fabric 9, will interfere with the path of the next weft inserter 2 shown in FIG. 5. The weft 3 will be displaced toward the discs 7 by the spreading spring 17 and simultaneously exerts a pressure upon said spreading spring 17. The latter, by its plate 25, in turn forces the pawl 23 against the action of the spring 24 into engagement with the ratchet wheel 22 so that the rotation of the bobbin 11 becomes blocked.

The spring tail 21 will direct the weft 3 from the preceding inserter 2 to the edge of the discs 7 of the rotary reed 6 which engages it by its cutouts 8. As the weft inserter 2 proceeds in its movement after blocking the bobbin 11, the weft 3 from the inserter 2 shown in FIG. 5 is simultaneously tensioned between the bobbin 11 and the fabric 9 until it breaks. As apparent from FIG. 8, the weft 3 from the next inserter 2 will be introduced fautlessly into the respective cutouts 8 of the discs 7 of the rotary reed 6. At the same time a suitable stop motion (not shown) switches off the loom.

As a result of the foregoing, the interwoven but untransferred weft 3, in accordance with the invention, is introduced into the cutouts 8 of the discs 7 of the rotary reed 6 belonging to the next inserter 2, in lieu of the weft 3 from said inserter 2 which last-mentioned weft 3 will break. In this way any chain-like formation of the wefts 3 interwoven but untransferred into the beat-up position is prevented. Alternatively, the weft yarn 3 can be severed by means of a suitable knife or shears (not shown) instead of being broken by the blocking of the rotation of the bobbin 11.

Figure 6:
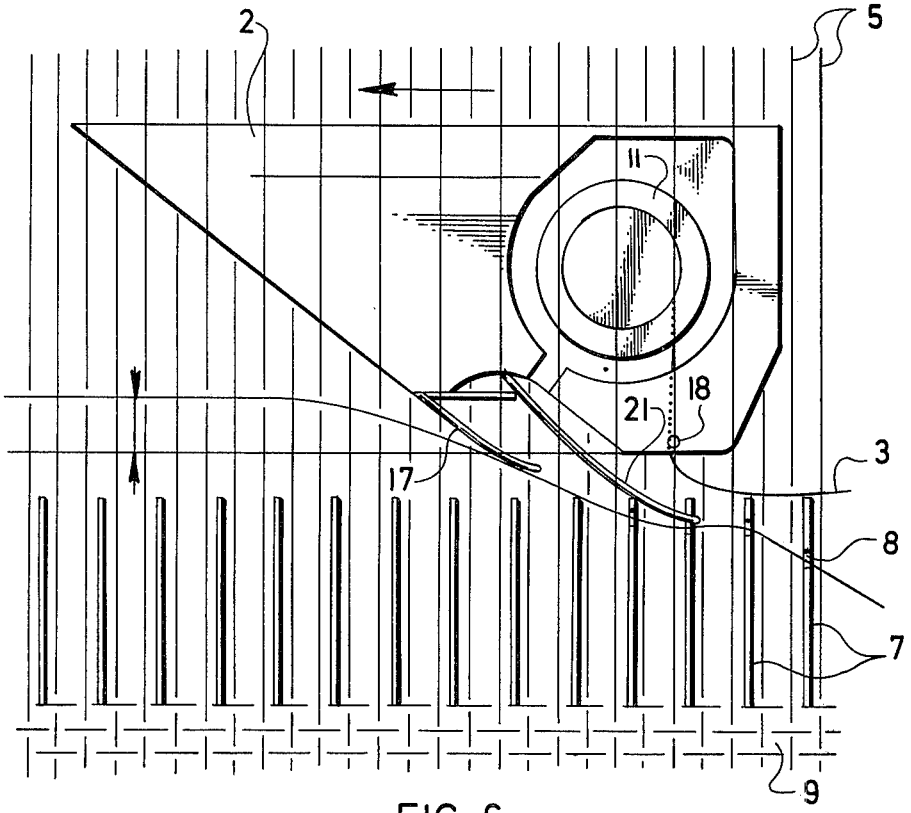
FIG. 6 is a top view of a second illustrative embodiment of a weft inserter in the weaving shed.

In the embodiment shown in FIG. 6, the weft inserter 2 is provided with the spring tail 21 only which is adapted to direct the untransferred weft 3 from the preceding inserter 2 to the edge of discs 7 of the rotary reed 6 for being engaged by the cutouts 8 belonging to the next inserter 2 as shown in FIG. 6.

The discs 7 engage by their cutouts 8 this preceding weft 3 and transfer it into the beat-up position. The weft 3 from the next inserter 2 cannot be transferred by the cutouts 8 of the disc 7 of the rotary reed 6 belonging thereto, since they transfer said preceding weft 3.

As shown in FIG. 9, the weft 3 from said next inserter 2 will be analogously directed as late as by the spring tail 21 of the next trailing inserter 2 to the edge of the discs 7 to be engaged by the cutouts 8 belonging to said next trailing inserter 2. Due to such a phase shift corresponding to the distance between the inserters 2 following each other, all the future wefts 3 are directed into the cutouts 8 of the discs 7 of the rotary reed 6 until the loom is switched off by a suitable stop motion.

Although the invention is illustrated and described with reference to a plurality of preferred embodiments, it is to be expressly understood that it is in no way limited to the disclosure of such a plurality of preferred embodiments, but is capable of numerous modifications within the scope of the appended claims.

What is claimed is:

1. Method of eliminating a chain formation of wefts not transferred into the beat-up position in a travelling-wave shedding loom with weft inserters and a rotary seed comprising discs with cutouts for engaging weft and displacing it to the fabric fell, the method comprising introducing an interwoven but not transferred weft into the cutouts of the discs of the rotary reed which correspond to the next weft inserter, in lieu of the weft from said next weft inserter.

2. The method as claimed in claim 1, comprising severing the weft from the next weft inserter.

3. The method as claimed in claim 1, comprising introducing the weft from the next weft inserter into the cutouts of the discs of the rotary reed, which cutouts correspond to the next following weft inserter, whereupon due to this phase-shift corresponding to the distance between two weft inserters following after each other, all the other wefts are successively directed into the cutouts of the discs of the rotary reed until the loom stops.

4. A weft inserter for eliminating a chain formation of wefts not transferred into the beat-up position in a travelling-wave shedding loom with weft inserters and a rotary reed comprising discs with cutouts for engaging weft and displacing it to the fabric fell, an interwoven but not transferred weft being introduced into the cutouts of the next weft inserter in lieu of the weft from said next weft inserter, said weft inserter comprising a rotatable bobbin with a weft length determined for a single pick and a spreading spring for spreading warp threads, the weft inserter comprising directing means for introducing an interwoven but not transferred weft from a preceding weft inserter into the cutouts of the discs of the rotary reed, said cutouts corresponding to the next weft inserter.

5. A weft inserter as claimed in claim 4, wherein the directing means is constituted by a spring tail provided in the weft inserter between the spreading spring and a weft guide.

6. A weft inserter as claimed in claim 4, wherein the directing means is associated with the bobbin rotation blocking means, the latter being controllable by the spreading spring.

7. A weft inserter as claimed in claim 6, wherein the bobbin rotation blocking means are constituted by a ratchet wheel provided on the bobbin, and by a spring-loaded pawl adapted to cooperate with said ratchet wheel and received in the weft inserter for being displaced from an inoperative position of not engaging said ratchet wheel, into an operative position with the outstanding spreading spring, in which operative position said pawl is in engagement with said ratchet pawl.

8. A weft inserter as claimed in claim 7, wherein the pawl is resiliently forced against a plate received in a pocket-like recess in the inserter body and secured to the spreading spring.

* * * * *